US010907317B2

(12) United States Patent
Borel et al.

(10) Patent No.: US 10,907,317 B2
(45) Date of Patent: Feb. 2, 2021

(54) METHOD FOR PRODUCING AN ANCHORING TIE ROD AND ANCHORING TIE ROD

(71) Applicant: SOLETANCHE FREYSSINET, Rueil-Malmaison (FR)

(72) Inventors: Serge Borel, Rueil-Malmaison (FR); Marie Lebreton, Rueil-Malmaison (FR); Juan Fernando Uribe, Rueil-Malmaison (FR); Felipe Gruber, Rueil-Malmaison (FR); Ivan Cubillos, Rueil-Malmaison (FR)

( * ) Notice: Subject to any disclaimer, the term of this patent is extended or adjusted under 35 U.S.C. 154(b) by 218 days.

(21) Appl. No.: 16/076,701

(22) PCT Filed: Feb. 9, 2017

(86) PCT No.: PCT/FR2017/050297

§ 371 (c)(1),
(2) Date: Aug. 9, 2018

(87) PCT Pub. No.: WO2017/137702

PCT Pub. Date: Aug. 17, 2017

(65) Prior Publication Data

US 2019/0048550 A1 Feb. 14, 2019

(30) Foreign Application Priority Data

Feb. 10, 2016 (FR) ..... 16 51052

(51) Int. Cl.

| | |
|---|---|
| ***E02D 3/12*** | (2006.01) |
| ***E02D 5/80*** | (2006.01) |
| ***E21B 7/00*** | (2006.01) |

(52) U.S. Cl.

CPC ..... *E02D 3/12* (2013.01); *E02D 5/808* (2013.01); *E21B 7/00* (2013.01)

(58) Field of Classification Search

CPC ..... E02D 3/12; E02D 3/126; E02D 5/808; E02D 5/44

See application file for complete search history.

(56) References Cited

U.S. PATENT DOCUMENTS 4,015,433 A 4/1977 Shibata
4,411,557 A * 10/1983 Booth ..... E02D 5/54 405/238

(Continued)

FOREIGN PATENT DOCUMENTS

CH 146798 A 5/1931
EP 1878833 A1 1/2008

(Continued)

*Primary Examiner* — Benjamin F Fiorello

(74) *Attorney, Agent, or Firm* — William Salinger; Yasser Mourtada; Robert Facey

(57) ABSTRACT

The invention provides a method of constructing a ground anchor, wherein the method comprises performing an introduction step for introducing the boring tool into the ground along a boring axis (F) so as to form a top portion (C1), the mixer device being in the retracted position during the introduction step; then performing a mixing step during which the mixer device is taken to the deployed position and the boring tool is driven in rotation with the mixer device (14) in the deployed position while moving the boring tool axially along the boring axis and while injecting the fluid so as to perform mechanical in-situ mixing of the ground in place with the fluid, thereby forming a bulb (B) in the ground under the top portion (C1), which bulb has a second diameter (D2) that is greater than the first diameter (D1); inserting a reinforcement into the bulb, whereby a ground anchor is obtained.

19 Claims, 7 Drawing Sheets

(56) References Cited

U.S. PATENT DOCUMENTS

| | | | | |
|---|---|---|---|---|
| 4,843,785 | A * | 7/1989 | Sero | E02D 5/72 52/160 |
| 5,348,424 | A * | 9/1994 | Tateyama | E02D 3/126 405/240 |
| 9,895,729 | B2 | 2/2018 | Perpezat et al. | |
| 9,976,272 | B2 | 5/2018 | Darson Balleur et al. | |
| 2004/0244998 | A1* | 12/2004 | Schellhorn | E02D 3/126 172/1 |
| 2011/0243666 | A1* | 10/2011 | Fox | E02D 5/44 405/232 |
| 2019/0153692 | A1* | 5/2019 | Han | E02D 5/80 |

FOREIGN PATENT DOCUMENTS

| | | | |
|---|---|---|---|
| EP | 2634313 | B1 | 11/2015 |
| ES | 2402975 | A | 5/2013 |
| JP | H11222846 | A | 8/1999 |
| WO | WO2016/009143 | A1 | 1/2016 |

* cited by examiner

METHOD FOR PRODUCING AN ANCHORING TIE ROD AND ANCHORING TIE ROD

BACKGROUND

The present disclosure relates to the field of constructing ground anchors, and in particular to the field of constructing anchoring tie-rods.

The disclosure is particularly applicable to fabricating anchoring tie-rods of medium capacity, made more particularly in soft earth.

Typically, an anchoring tie-rod is a device capable of transmitting the traction forces that are applied thereto to a layer of ground by bearing against a reaction mass constituting the structure that is to be anchored.

In general, an anchoring tie-rod is made up of:

- an anchor head that transmits traction forces from the reinforcement to the structure for anchoring via a bearing piece;
- a reinforcement;
- a bonded portion whereby the traction force is transmitted to the surrounding terrain; and
- an unbonded portion arranged between the bonded portion and the structure for anchoring.

In ground having mediocre mechanical capacities, such as soft earth, conventional bonding for anchoring tie-rods does not enable sufficient forces to be engaged to anchor the structure for anchoring correctly.

Also known are Documents CH 146 798 and U.S. Pat. No. 4,015,433, which describe anchors.

SUMMARY

An object of the present disclosure is to solve the above-mentioned drawbacks by proposing a method of fabricating an anchor that provides better bonding of the reinforcement in the ground.

For this purpose, embodiments of the disclosure provide a method of constructing a ground anchor, wherein:

- there are provided a reinforcement and a boring machine that comprises:
  - a boring tool that is rotatable about a longitudinal axis, the boring tool being provided with a deployable mixer device that presents a retracted position and a deployed position, the mixer device in the deployed positioned presenting a diametral span that is greater than its diametral span in a retracted position; and
  - a device for injecting at least one fluid into the ground;
- the method comprising:
- performing an introduction step for introducing the boring tool into the ground along a boring axis parallel to the longitudinal axis so as to form a top portion having a first diameter, a first height, and extending to a first depth, the mixer device being in the retracted position during the introduction step; then
- performing a mixing step during which the mixer device is taken to the deployed position and the boring tool is driven in rotation with the mixer device in the deployed position while moving the boring tool axially along the boring axis and while injecting the fluid so as to perform mechanical in-situ mixing of the ground in place with the fluid, thereby forming a bulb in the ground under the top portion, which bulb has a second diameter that is greater than the first diameter; and

- performing an insertion step during which the reinforcement is inserted in the bulb, whereby a ground anchor is obtained.

Performing the method of the disclosure thus makes it possible to obtain a ground anchor that has a top portion with a first diameter and a bulb of substantially cylindrical shape having a second diameter that is greater than the first diameter.

Because of this difference in diameter between the top portion and the bulb, the bonding capacity of the ground anchor is significantly improved.

In addition, the use of a deployable mixer device makes it possible to guarantee the diameter of the bulb. By way of example, the boring machine may be a tool as described in Documents EP 1 878 833, EP 2 931 979, ES 2 402 975, or JP 11 222 846.

It is specified that the step of mixing the ground in place with the fluid may be performed while moving the boring tool along the boring axis in a first direction, in a second direction opposite to the first direction, or indeed in both directions. When the boring axis is vertical, the mixing step is performed during a stage of lowering and/or a stage of raising the boring tool.

Preferably, but not exclusively, the fluid is a binder, such that the bulb comprises a first material forming a mixture constituted by the ground in place mixed with the binder.

Also preferably, the step of introducing the boring tool into the ground is accompanied by injecting a boring fluid, e.g. water.

When the anchor is an anchoring tie-rod, it can be understood that the top portion constitutes the unbonded portion of the tie-rod, while the bulb constitutes the bonded portion of the tie-rod. The reinforcement is then fastened to an anchor head. The difference in diameter between the unbonded portion and the bonded portion significantly improves the bonding capacity of the tie-rod. In addition, the shoulder formed between the bulb and its top portion contributes advantageously to bonding the bulb in the ground.

Preferably, but not exclusively, the reinforcement is inserted into the bulb after withdrawing the boring tool.

Preferably, the second diameter is not less than twice the first diameter. Also preferably, the second diameter is not less than three times the first diameter. Also preferably, the second diameter is not less than four times the first diameter.

Preferably, the second diameter of the bulb is not less than 400 millimeters (mm), while the first diameter of the top portion lies in the range 100 mm to 300 mm.

Preferably, but not necessarily, the bulb presents a cylindrical portion terminated by a frustoconical portion connecting the cylindrical portion to the top portion.

The length of the bulb depends in particular on the force to be taken up by the anchor and on the characteristics of the terrain, and in particular on lateral friction.

In the disclosure, after the mixing step, the boring tool is withdrawn from the ground and then during the insertion step:

- a borehole is made in the bulb along the boring axis and having a third diameter less than the second diameter;
- the borehole is filled with a bonding grout; and
- the reinforcement is inserted into the borehole, before or after filling the borehole with the bonding grout.

It can thus be understood that the reinforcement is covered with the bonding grout. In other words, the reinforcement is embedded in a volume of grout that extends at least inside the bulb. The volume of grout preferably extends also in the top portion.

The borehole is preferably made in the bulb while the first material is still fresh.

In an implementation, the reinforcement is a self-boring reinforcement that is constituted by the boring device that is used for making the borehole in the bulb.

In a first variant, the third diameter is less than the first diameter.

In an advantageous second variant, the third diameter is not less than the first diameter of the top portion. In this way, the first material that constitutes the top portion at the end of the mixing step is replaced by the bonding grout at the end of the filling step. An anchor is thus obtained that has a top portion (possibly wider than its initial top portion) that is constituted by the bonding grout, this top portion extending longitudinally in the bulb.

In this advantageous second variant, and when the anchor is an anchoring tie-rod, the bonding grout is selected to that the friction between the grout and the first material is greater than the friction between the grout and the ground, thereby making it possible in particular to reduce the length of the bonded portion in comparison with a conventional tie-rod.

Furthermore, the disclosure makes it possible to guarantee a large amount of friction between the reinforcement and the grout.

Preferably, the grout is a cement grout presenting a cement over water ratio (C/W) by weight of about 2. It may equally be a resin or any other settable substance. The lateral friction that is obtained is preferably of the order of 1 megapascal (MPa).

In an advantageous implementation, the boring machine further comprises a tubular element having a diameter and a bottom end, the mixer device being shaped to be capable of being received inside the tubular element when the mixer device is in the retracted position, the diametral span of the mixer device in the deployed position being greater than the diameter of the tubular element, the method comprising, during the step of introducing the boring tool into the ground:

- introducing the tubular element into the ground to the first depth along the boring axis;
- introducing the boring tool in the retracted position into the tubular element; then
- after the step of introducing the boring tool into the ground, moving the boring tool axially along the boring axis relative to the tubular element so as to move the mixer device under the bottom end of the tubular element and then performing said mixing step.

The tubular element serves in particular to facilitate inserting the mixer device into the ground while it is in the retracted position. It also serves to support the terrain and guarantee the first diameter for the top portion.

Advantageously, after the mixing step, the mixer device in the retracted position is put into the tubular element, and then during the introduction step:

- the boring tool is secured to the tubular element;
- the assembly constituted by the boring tool and the tubular element is driven in rotation and said assembly is moved towards the bottom end of the bulb along the boring axis so as to make a borehole in the bulb;
- the boring tool is separated from the tubular element;
- the boring tool is withdrawn while leaving the tubular element in the bulb;
- the reinforcement is inserted into the tubular element; and
- the borehole is filled with the bonding grout.

It can be understood that the tubular element serves both as a guide for facilitating insertion of the reinforcement into the ground, and also as a duct for delivering grout into the borehole. The tubular element serves to fill the borehole with the bonding grout from its bottom portion, thereby facilitating filling. The reinforcement is preferably a tube that is open at its bottom end in order to facilitate filling. It may also be a bar attached to a hose or to a tube with sleeves.

Advantageously, during the introduction step, the tubular element is introduced initially into the ground, and then the boring tool is introduced into the tubular element that has previously been introduced into the ground.

Or alternatively, during the introduction step, the tubular element together with the boring tool are introduced simultaneously into the ground, the mixer device being previously put in its retracted position and secured to the tubular element.

Preferably, the tubular element is withdrawn at the end of or during the insertion step.

In a variant, the step of filling with the bonding grout can be performed while the boring tool is being withdrawn.

In a preferred implementation, the boring tool has a tubular body extending along the longitudinal axis, and the mixer device has two deployable wings that are mounted to pivot relative to the tubular body, and the mixer device further comprises spring members arranged between the tubular body and each of the deployable wings, the spring members tending to bring the mixer device into the deployed position by pivoting the deployable wings.

As the boring tool, it is possible to use the tools described in EP 1 878 833, EP 2 931 979, ES 2 402 975, or indeed the tool described in JP 11 222 846.

Advantageously, the fluid is injected under pressure during the mixing step. An advantage is to assist in destructuring the ground and in mixing the grout with the ground. The pressure that is applied may lie in the range a few kilopascals (kPa) up to the high pressures used for jet-grouting, of the order of 60 MPa or more.

In another implementation of the disclosure, at the end of the mixing step and before the insertion step, the initial material of the bulb constituted by the mixture of the ground in place with the fluid is replaced by a bonding material. Preferably, the fluid is a drilling fluid, e.g. water, and the bonding material is a mortar. This variant can be performed advantageously in the presence of clayey ground. The replacement step preferably consists in injecting the filling material into the bulb while removing the initial material of the bulb. Also preferably, at the end of the mixing step, fluid injection is continued in order to remove the initial material, after which the mortar is injected.

Embodiments of the disclosure also provide a method of constructing a prestressed anchoring tie-rod in ground beside a reaction mass, by performing the method of the disclosure for constructing an anchor and wherein the introduction step includes a preliminary step of making a borehole in the reaction mass in which, after obtaining the anchor, a tie-rod head is placed between the reaction mass and the reinforcement, and then the reinforcement is put under tension.

The reaction mass may be a wall, a foundation raft or slab, or any other structure for anchoring.

Embodiments of the disclosure also provide a ground anchor, wherein, when considered from the surface of said ground, said anchor extends along a longitudinal axis and comprises in succession a top portion presenting a diameter, followed by at least one bulb presenting a diameter greater than the diameter of the top portion, the top portion and the bulb comprising at least a first material, and the anchor also comprises a reinforcement extending along the longitudinal axis in the top portion and in the bulb.

Advantageously, the first material is constituted by mixing the excavated ground with a binder. The proportions of ground and binder within the first material should be selected as a function of the type of terrain and of the target strength for the anchor. In a variant, the proportion of ground is less than 10%.

In the disclosure, the reinforcement is covered in a second material having a covering diameter that is less than the diameter of the bulb. Preferably, the covering diameter is not less than the diameter of the top portion. The second material is advantageously different from the first material.

Also preferably, the second material forms a cylindrical covering extending longitudinally in the bulb and in the top portion.

Advantageously, the second material is a bonding grout.

The reinforcement of the anchor preferably comprises a metal bar, a tube, or at least one strand.

Finally, embodiments of the disclosure provide an anchoring tie-rod comprising an anchor of the disclosure.

BRIEF DESCRIPTION OF THE DRAWINGS

The disclosure can be better understood on reading the following description of implementations of the disclosure given as non-limiting examples, and with reference to the accompanying drawings, in which.

DETAILED DESCRIPTION

Figure 1:
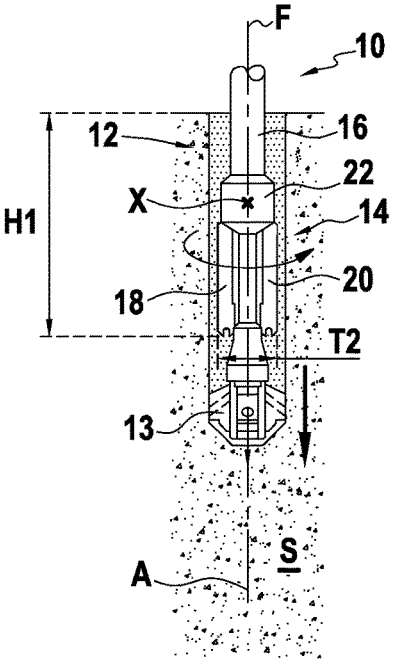
FIG. 1 shows the step of introducing the boring tool into the ground in a first implementation of the method in accordance with the disclosure.

With reference to FIGS. 1 to 5, there follows a description of a first implementation of the method of constructing a ground anchor 100.

In order to perform the method, there is provided a boring machine 10 of the kind described in EP 1 878 833 or EP 2 931 979. The boring machine 10, which is not described in detail herein, comprises a boring tool 12 that rotates about a longitudinal axis A. The means for driving the boring tool 12 in rotation are known from elsewhere and they are not described herein. The boring tool 12 is also provided with a deployable mixer device 14 that presents a retracted position as shown in FIG. 1, and a deployed position as shown in FIG. 2.

The boring tool 12 has a tubular body 16 extending along the longitudinal axis A; the mixer device 14 has two deployable wings 18 and 20 that are mounted to pivot relative to the tubular body 16 about a pivot axis X that is perpendicular to the longitudinal axis A. The mixer device also has spring members (not shown) that are arranged between the tubular body 16 and each of the deployable wings 18, 20. In known manner the spring members tend to urge the mixer device into the deployed position by pivoting the deployable wings about the axis X.

Figure 2:
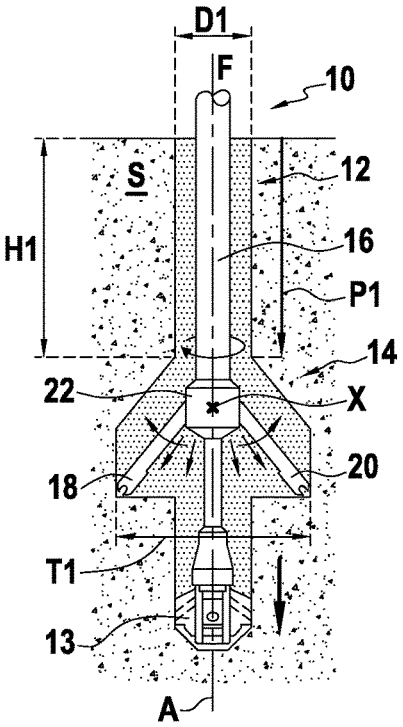
FIGS. 2 and 3 show the mixing step during which the bulb is formed.

With reference to FIGS. 1 and 2, it can be seen that the mixer device 14, when in its deployed position shown in FIG. 2, presents a diametral span T1 that is greater than its diametral span T2 when in the retracted position.

The boring machine 10 also has a device 22 for injecting fluid under pressure into the ground. In this example, the fluid is a binder.

In this example, fluid is injected into the ground S via nozzles arranged in the tubular body 16 of the boring tool, in the proximity of the wings 18, 21.

In the first implementation of the method of the disclosure, an introduction step is performed of introducing the boring tool into the ground along a boring axis F that is parallel to the longitudinal axis A so as to form a top portion C having a height H1 and a first diameter D1. As shown in FIG. 2, the top portion C extends from the surface of the ground to a first depth P1.

In this example, the top portion C is substantially cylindrical in shape with a diameter D1. With reference to FIG. 1, it can be understood that the mixer device is in the retracted position during the introduction step. It is specified that the diametral span T2 of the mixer device when in the retracted position is substantially equal to or slightly less than the diameter D1.

The boring tool 12 also has a cutter member 13 that is arranged at the distal end of the tubular body 16 below the mixer device. This cutter member 13 is configured to bore into the ground S along the boring axis. After the mixer device has reached a depth greater than the height H1 of the top portion, a mixing step is performed during which the mixer device is taken to the deployed position by deploying the wings 18 and 20. Thereafter, the boring tool is driven in rotation together with the mixer device 14 in the deployed position while injecting the binder so as to perform in-situ mechanical mixing of the ground in place with the binder. During this mixing step, the boring tool is moved axially along the boring axis F so as to form a bulb B in the ground, under the top portion C.

Figure 3:
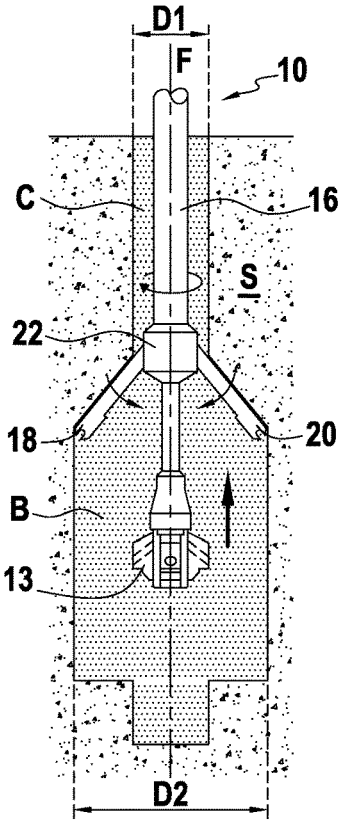

As can be understood from FIGS. 2 and 3, the bulb B presents a second diameter D2 that is greater than the first diameter D1 of the top portion. In the example shown in FIGS. 2 and 3, the bulb B is made going downwards, with the wings being deployed immediately below the top cavity.

Alternatively, and without going beyond the ambit of the present disclosure, the wings could be deployed once the boring tool has reached the depth corresponding to the depth of the bottom portion of the bulb B. Under such circumstances, the bulb would be formed going upwards while raising the boring tool 12.

In preferred manner, the wings are deployed automatically, such that the bulb B is made going downwards by the mixer device being moved longitudinally while in the deployed position and by injecting fluid.

Figure 4:
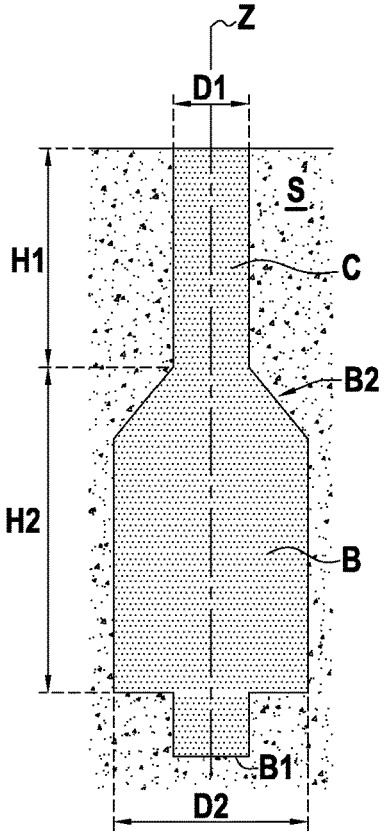
FIG. 4 is a longitudinal section view of the ground after the boring tool has been withdrawn.
Figure 5:
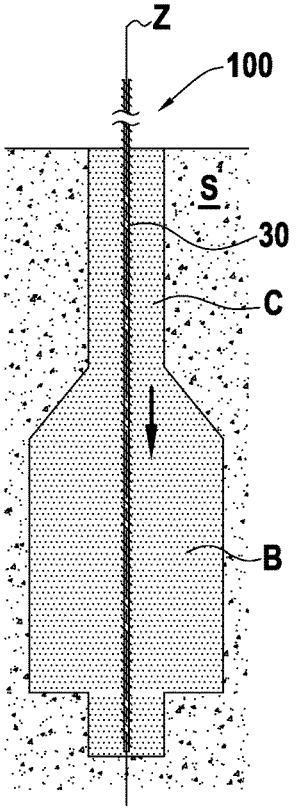
FIG. 5 shows the step of inserting reinforcement into the bulb.
Figure 6:
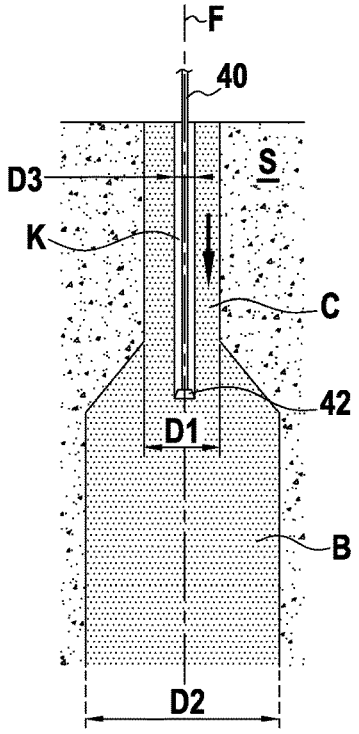
FIG. 6 shows the step of boring the bulb in a second implementation of the method of the disclosure.

FIG. 4 shows the ground in vertical section after the boring tool has been withdrawn. It can be seen that the bulb B is cylindrical in shape, extending over a height H2. It can be understood that the second diameter D2 corresponds to the maximum diameter of the bulb B. Given the particular shape of the boring tool 12, the bulb B presents, at its bottom end B1, an extension of diameter that is less than the second diameter D2. The bulb also includes at its top end B2 a frustoconical shape making the junction between the cylindrical portion of diameter D2 and the top portion C of diameter D1. This frustoconical shape enhances the bonding of the bulb in the ground.

Without going beyond the ambit of the present disclosure, bulbs B of other shapes could be obtained depending on the type of boring tool used.

In accordance with the disclosure, an insertion step is then performed during which a reinforcement 30 is inserted into the bulb B after the boring tool 12 has been withdrawn from the ground. In this example, the reinforcement 30 is constituted by a metal bar that is inserted along the boring axis. Once the ground-and-binder mixture has hardened, the resulting ground anchor 100 extends along a longitudinal axis Z corresponding to the boring axis F.

With reference to FIGS. 6 to 9, there follows a description of a second implementation of the disclosure.

In this second implementation, the steps of introducing the boring tool into the ground and the mixing step are similar to those of the first implementation.

However the second implementation differs from the first implementation in that, after the mixing step, the boring tool is withdrawn from the ground and then, during the insertion step: a borehole K is made in the bulb B along the boring axis F before the ground-and-binder mixture hardens.

Figure 7:
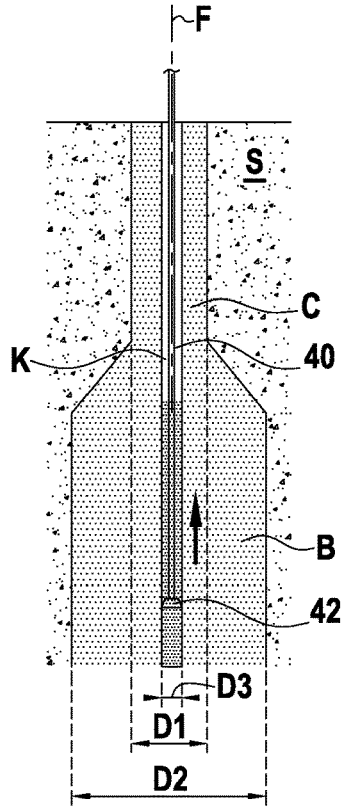
FIG. 7 shows the step of boring the FIG. 6 borehole with the grout.

The borehole K presents a third diameter D3 that is less than the second diameter D2 of the bulb B. The borehole K is made using a boring device 40 of tubular shape having an open bottom end carrying cutter means 42. As shown in FIG. 7, after making the borehole K, the borehole is filled with the bonding grout. In this example, filling with grout is performed by injection through the boring device 40 while the boring device is being raised.

Figure 8:
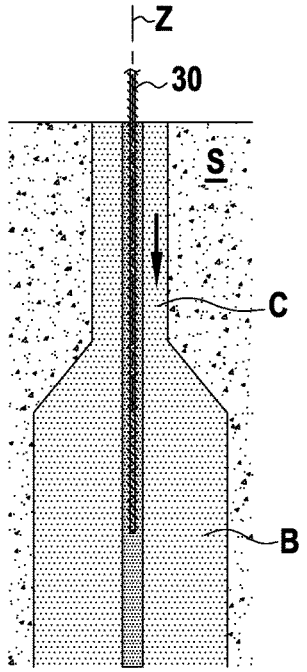
FIG. 8 shows a step of inserting the reinforcement in the borehole filled with the bonding grout.

Thereafter, after filling, the reinforcement 30 is inserted into the borehole K, as shown in FIG. 8. Alternatively, and without going beyond the ambit of the present disclosure, the reinforcement 30 could be inserted into the borehole K before the step of filling it with grout. In this example, the bonding grout is cement grout presenting a cement over water ratio (C/W) of about 2.

Figure 9:
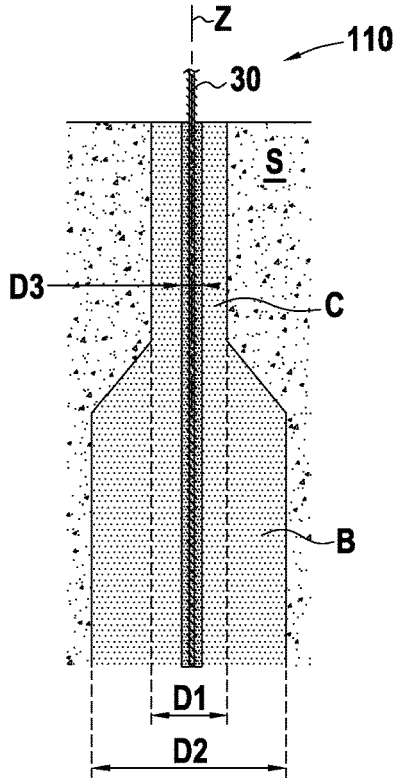
FIG. 9 shows the anchor obtained by performing the method in the second implementation of the disclosure.

FIG. 9 shows the anchor 110 obtained by performing the second implementation of the disclosure.

The grout is selected in such a manner that friction between the reinforcement and the grout is high, of the order of 1 MPa. It is also selected in such a manner that friction between the grout and the mixture resulting from mixing the ground with the binder is greater than the friction between said mixture and the ground surrounding the anchor.

Figure 22:
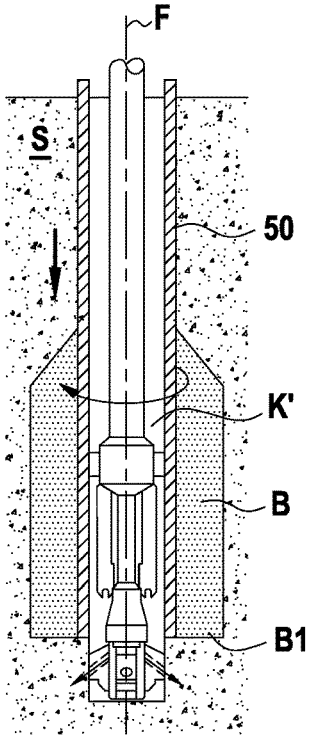
FIG. 22 shows a fifth implementation of the disclosure in which the tubular element is secured to the boring tool in order to be moved in the bulb while boring the bulb.

In the example shown in FIGS. 6 to 9, the third diameter D3 is also less than the second diameter D1. Without going beyond the ambit of the present disclosure, the third diameter D3 could be equal to or slightly greater than the diameter D1 of the top portion, so as to replace the material constituting the top portion, namely the above-mentioned mixture, with the bonding grout. This variant is shown in particular in FIG. 22, which is described below.

Figure 10:
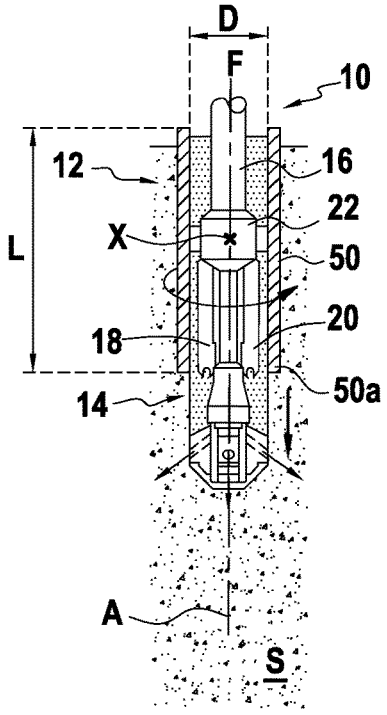
FIG. 10 shows the step of introducing the boring tool into the ground in a third implementation of the method of the disclosure, the boring tool and a tubular element secured thereto being inserted together into the ground.
Figure 11:
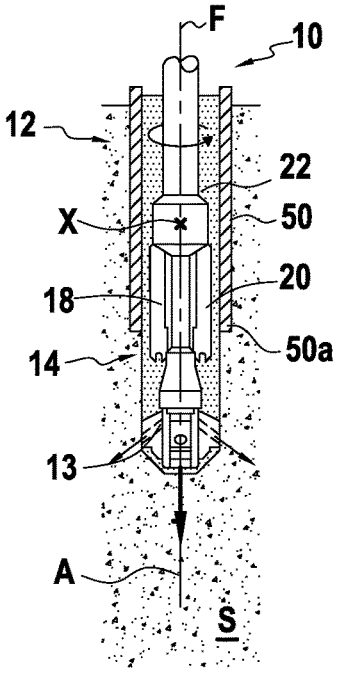
FIG. 11 shows the step during which the boring tool is separated from the tubular element.
Figure 12:
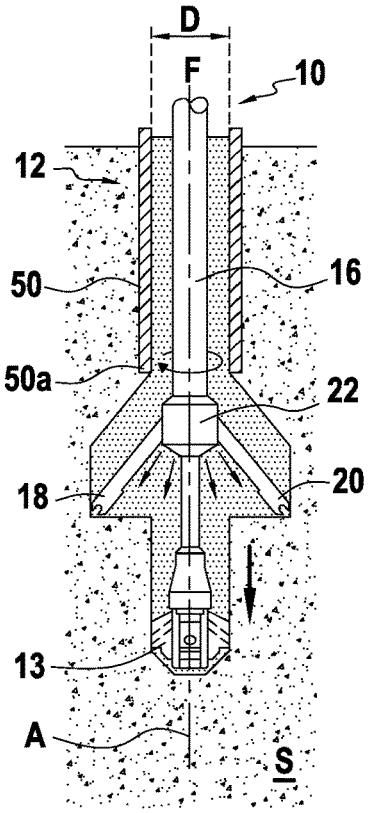
FIGS. 12 and 13 show the bulb being formed by in-situ mixing of the excavated ground with a fluid.

FIGS. 10 to 15 show a third implementation of the method of the disclosure. The third implementation of the method differs from the above-described first implementation by the fact that the boring machine also has a tubular element 50 that presents a diameter D and a bottom end 50*a*, occupying a length L. As can be understood from FIG. 10, the mixer device is shaped to be received in the tubular element 50 when the mixer device is in its retracted position. With reference to FIGS. 10 and 12, it can be understood that the diametral span T1 of the mixer device in the deployed position is greater than the diameter D of the tubular element 50. It can also be understood that the diametral span T2 of the mixer device in the retracted position is less than the diameter D of the tubular element 50.

In the third implementation, the tubular element 50 is introduced into the ground along the boring axis F after previously placing the boring tool in the retracted position inside the tubular element 50. For this purpose, the boring tool 12 is secured to the tubular element 50 and the assembly constituted by the tubular element secured to the boring tool is introduced into the ground along the boring axis, as shown in FIG. 10.

Figure 13:
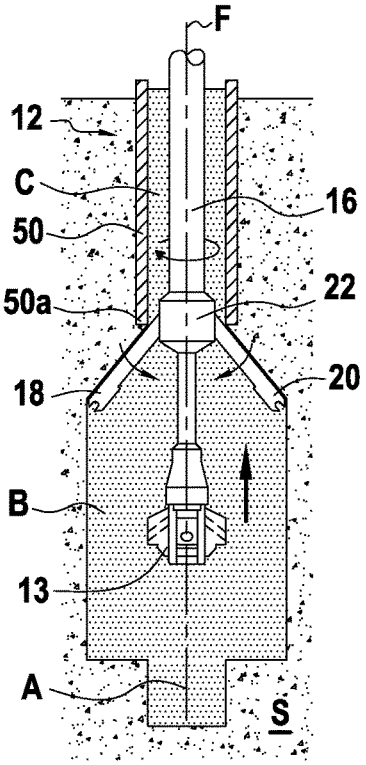

As shown in FIGS. 11 to 13, after said assembly has been introduced, the boring tool is separated from the tubular element and the boring tool 12 is then lowered axially along the boring axis F relative to the tubular element 50. In this way, the mixer device 16 is moved under the bottom end 50*a* of the tubular element 50, after which the step of in-situ mixing of the excavated ground with the binder is performed.

Figure 14:
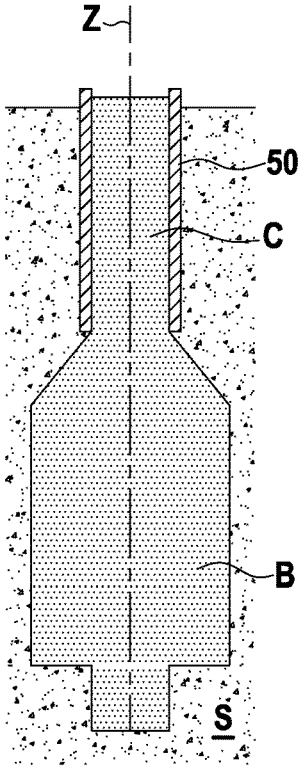
FIG. 14 is a longitudinal section view of the ground after withdrawing the boring tool.
Figure 15:
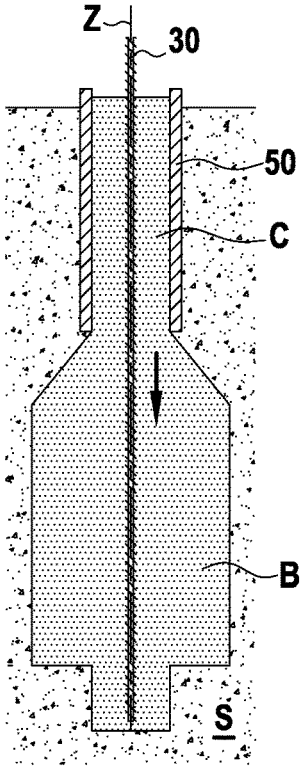
FIGS. 15 and 16 show the reinforcement being inserted into the bulb and the tubular element being withdrawn.
Figure 16:
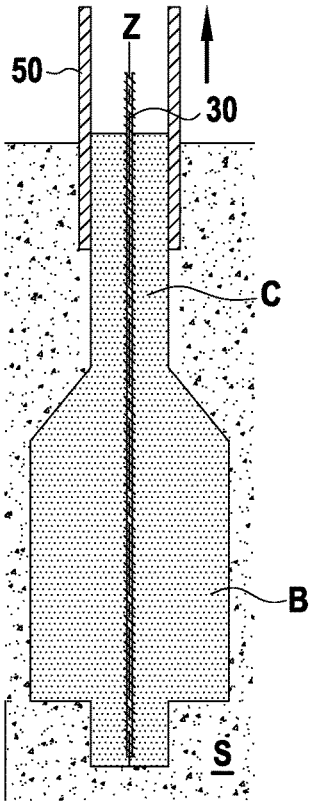
Figure 17:
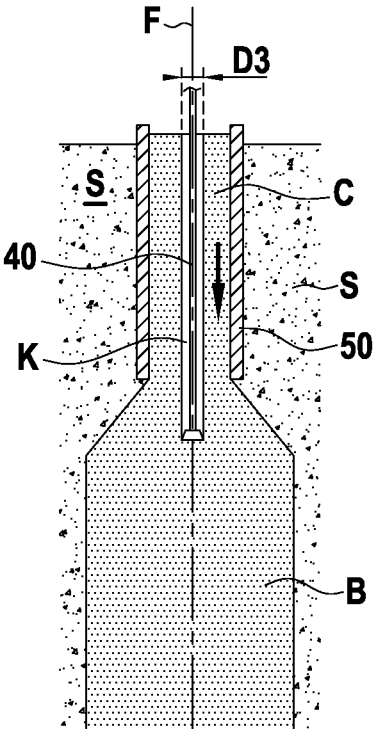
FIG. 17 shows the step of boring the bulb in a fourth implementation of the method of the disclosure.
Figure 18:
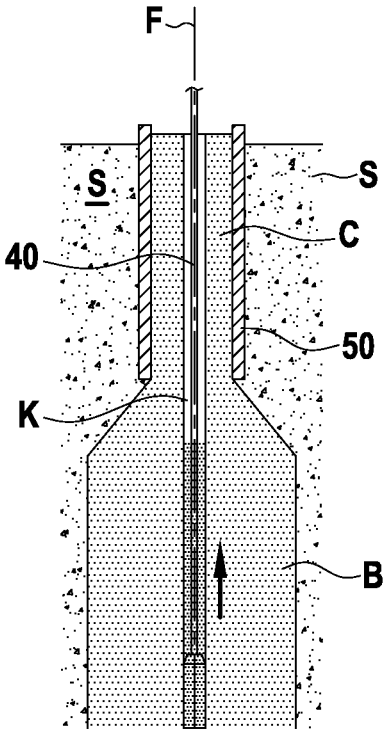
FIGS. 18 to 21 show the step of filling the borehole made in the bulb with a grout, the step of inserting the reinforcement into the filled borehole, and the step of withdrawing the tubular element.
Figure 19:
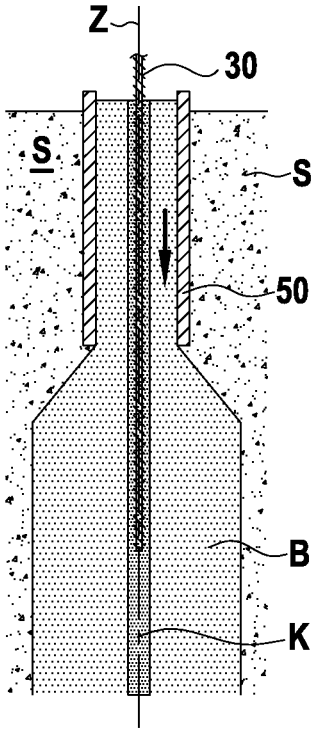
Figure 20:
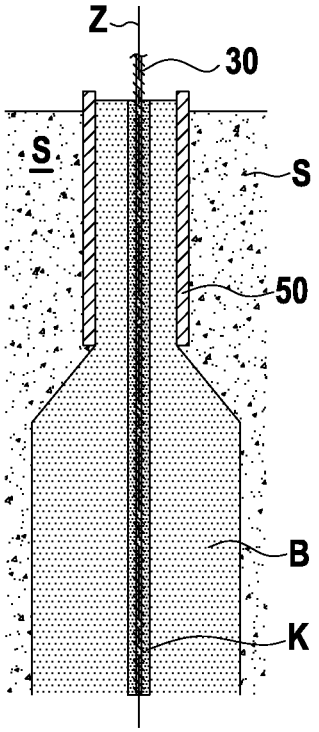
Figure 21:
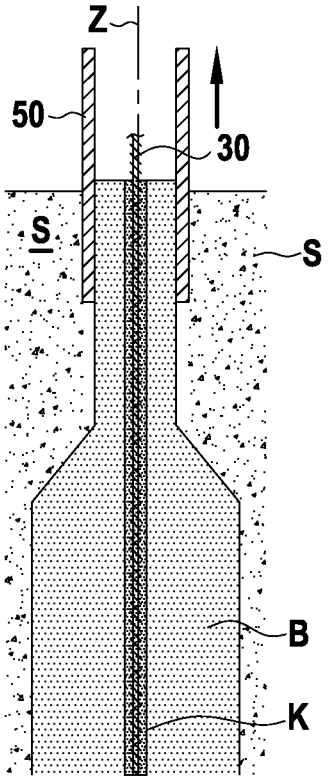

With reference to FIG. 14, it can be seen that the tubular element 50 surrounds and defines the top portion C that is located above the bulb B. After withdrawing the boring tool 12, the reinforcement 30 is introduced into the bulb along the boring axis F, after which the tubular element 50 is withdrawn.

FIGS. 17 to 21 show a fourth implementation of the method of the disclosure that differs from the third implementation by the fact that after withdrawing the boring tool 12 from the ground S, and during the insertion step: a borehole K is made in the top portion C and in the bulb B along the boring axis F and with a third diameter D3 less than the second diameter D2. Thereafter, the borehole is filled with the bonding grout prior to inserting the reinforcement 30 into the borehole K. Thereafter the tubular element is withdrawn from the ground.

With reference to FIGS. 22 to 26, there follows a description of a fifth implementation of the method of the disclosure. This implementation differs from the third implementation by the fact, after the mixing step, the mixer device, while in the retracted position, is taken into the tubular element 50, and then during the introduction step, the boring tool 12 is secured to the tubular element 50 and the assembly constituted by the boring tool 12 and the tubular element 50 is driven in rotation, with said assembly then being moved towards the bottom end B1 of the bulb B. This movement takes place along the boring axis F so as to make a borehole K' in the bulb B, it being recalled that the bulb B at this time is constituted by a fresh mixture resulting from mixing the excavated ground with the binder.

Figure 23:
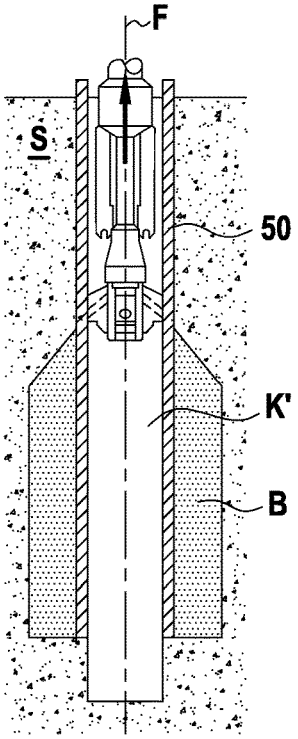
FIG. 23 shows the boring tool being withdrawn while the tubular element remains in the bulb.
Figure 24:
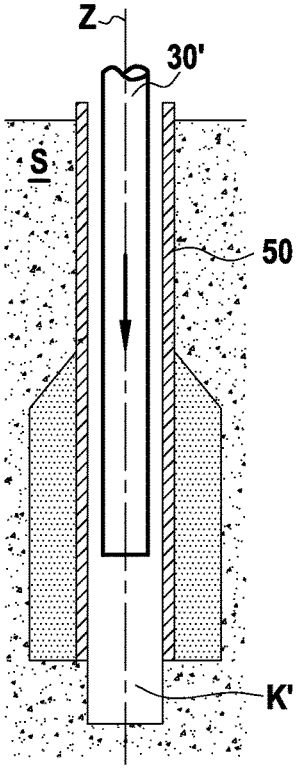
FIG. 24 shows the step of inserting reinforcement in the form of a tube into the tubular element.
Figure 25:
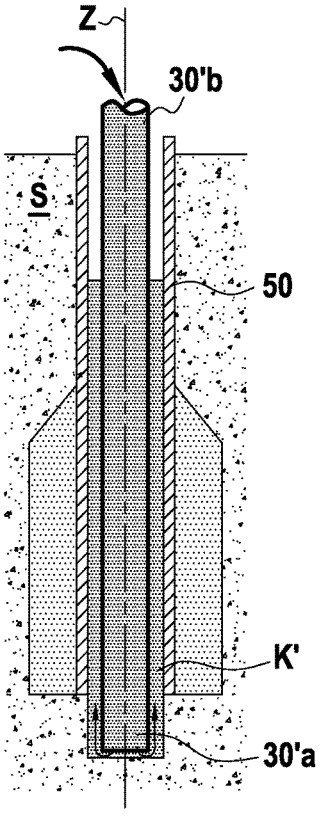
FIG. 25 shows the borehole made in the bulb being filled by injecting a grout into the tube.
Figure 26:
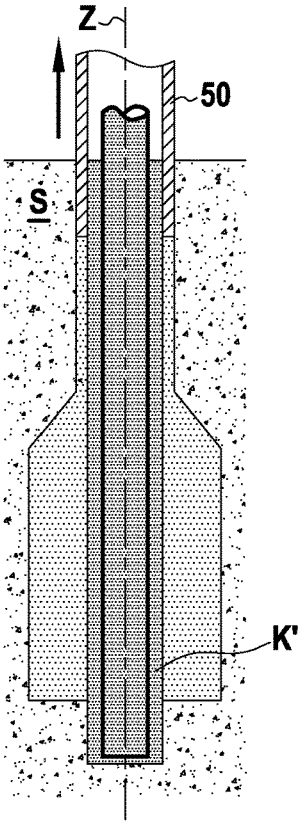
FIG. 26 shows the tubular element being withdrawn.

After making the borehole K', the boring tool 12 and the tubular element 50 are separated, and then the boring tool is withdrawn from the ground while leaving the tubular element 50 in the bulb B, as shown in FIG. 23.

Thereafter, the reinforcement 30' is inserted into the tubular element 50. In this example, the reinforcement 30' is constituted by a tube that is open at its bottom end 30'*a* and at its top end 30'*b*.

After introducing the reinforcement 30' into the tubular element 50, the tubular element 50 is filled with the bonding grout so as to fill the borehole K'. This filling is performed by injecting the bonding grout through the top end 30'*b* of the reinforcement 30' so as to discharge the grout from the bottom end of the reinforcement. After the borehole K' has been filled with the bonding grout, the tubular element 50 is withdrawn from the ground so as to obtain the anchor.

The reinforcement 30' could equally well be a bar or a strand associated with an injection device such as a sleeve tube or more simply a hose. Without going beyond the ambit of the present disclosure, filling could equally well be performed during the step shown in FIG. 23.

Figure 27:
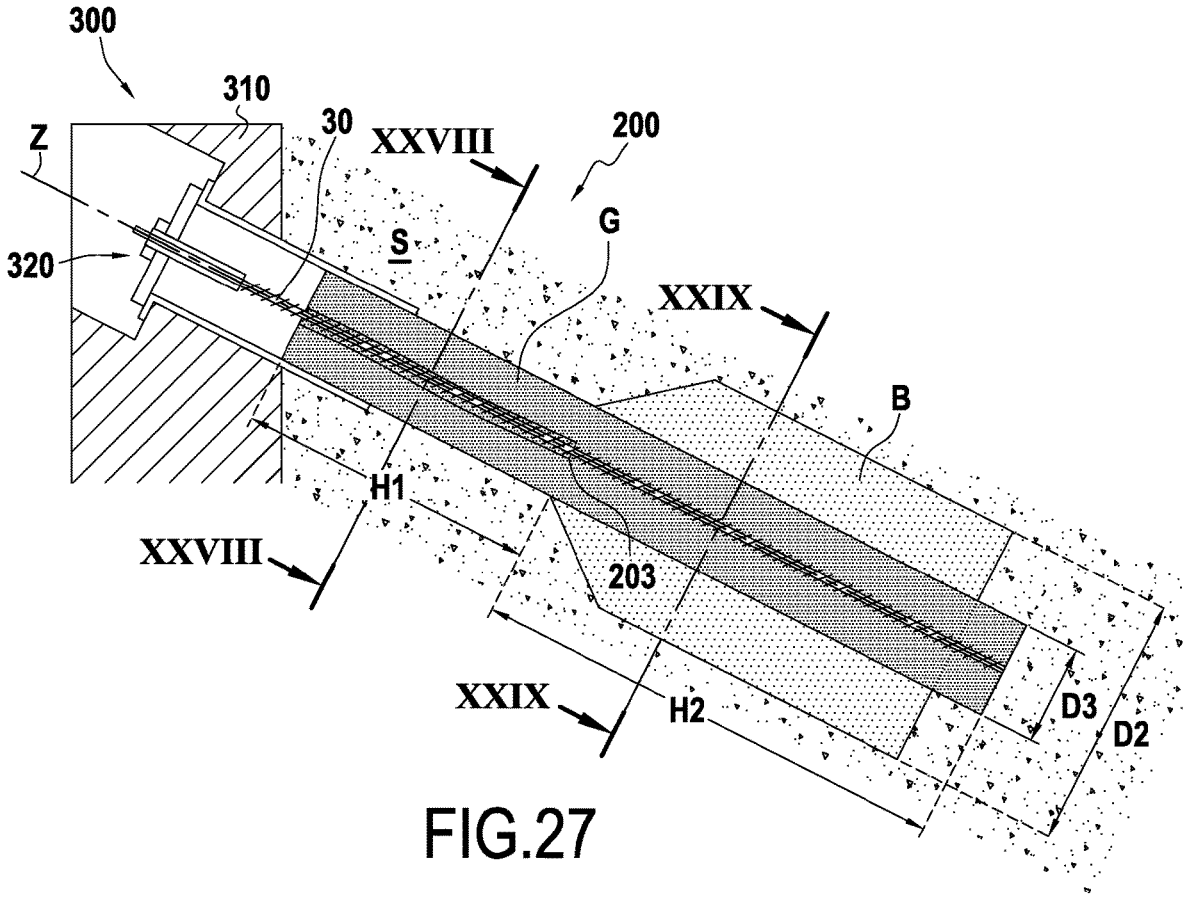
FIG. 27 shows an anchoring tie-rod of the present disclosure.

FIG. 27 shows an anchoring tie-rod 300 comprising an anchor 200 made using the second, fourth, or fifth implementation of the method of the disclosure.

The anchoring tie-rod 300 is secured to a reaction mass 310 adjacent to the ground. In this non-limiting example, the reaction mass 310 is a vertical concrete wall.

To make the anchoring tie-rod 300, the above-mentioned introduction step comprise a preliminary step of boring the reaction mass 310. This boring is performed along a boring axis that slopes relative to the vertical axis such that the longitudinal axis Z of the anchoring tie-rod slopes relative to the vertical.

Thereafter, the anchor 200 is made by performing the method of the disclosure. When considered from the surface, the anchor 200 comprises in succession a top portion G followed by at least one bulb B that presents a diameter D2 greater than the diameter D3 of the top portion P. The top portion G extends over a height H1, while the bulb extends over a height H2. It is specified that the top portion G is for forming the unbonded portion of the anchoring tie-rod, while the bulb B forms the bonded portion of the anchoring tie-rod 300. In the unbonded portion, friction is reduced significantly by means of a device 203, such as a greased sheath, or a reinforcement covered in a non-stick coating.

Figure 28:
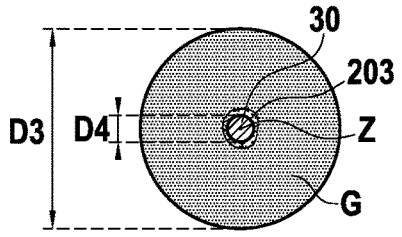
FIGS. 28 and 29 are cross-section views of the top portion and of the bulb of the FIG. 27 tie-rod.
Figure 29:
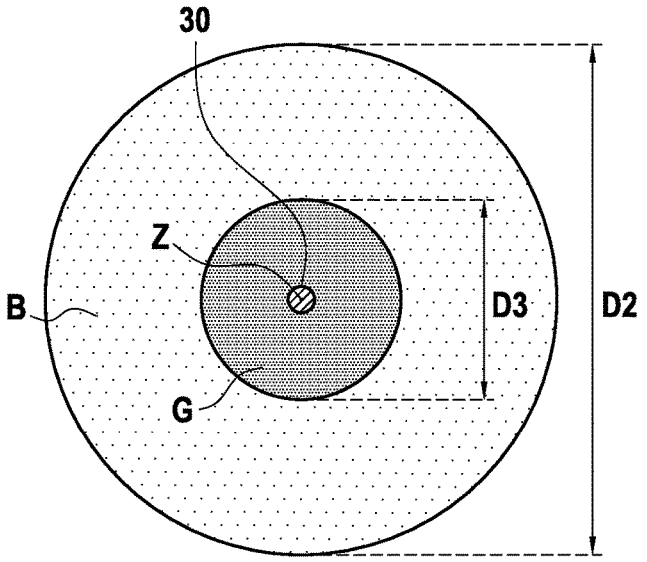

With reference to FIGS. 27 to 29, it can be also be seen that the top portion G forms the top portion of a cylindrical core constituted by the bonding grout that extends longitudinally in the bulb B. From FIG. 29, it can be understood that the bulb B is constituted by an annular layer of mixture constituted by a ground-and-binder mixture surrounding the cylindrical grout core.

The anchor 200 also has reinforcement 30, specifically a metal bar of diameter D4 that extends in the axis Z in the top portion G and in the bulb B.

Furthermore, it can be understood that the cylindrical grout core covers the reinforcement 30 over more than two-thirds of its length. It can thus be understood that the bulb B is made out of a first material resulting from mixing the excavated ground with the binder and a second material, specifically the bonding grout, which surrounds the reinforcement 30, the first material surrounding the second material.

By way of example, the diameter D2 of the bulb B is equal to 600 mm, while the coefficient of friction between the first material and the ground is 80 kPa.

The diameter of the cylindrical core extending inside the bulb B and made of the second material presents a diameter D3 equal to 150 mm and a coefficient of friction between the first and second materials of about 320 kPa.

Finally, the diameter of the reinforcement 30 is 50 mm, and the coefficient of friction between the reinforcement and the second material is about 960 kPa.

After constructing the anchor 200, a tie-rod head 320 is mounted at the top end of the top portion G, this tie-rod head being secured to the reaction mass and to the reinforcement 30. After putting the tie-rod head 320 into position, the reinforcement 30 is put under tension so as to apply prestress to the anchoring tie-rod 300. Even though some features, concepts or aspects of the embodiments may be described herein as being a preferred (more or less) arrangement or method, or an advantageous arrangement or method, such description is not intended to suggest that such feature or features are required or necessary unless expressly so stated.

The invention claimed is:

1. A method of constructing a ground anchor, comprising:

providing a reinforcement and a boring machine that comprises:

a boring tool that is rotatable about a longitudinal axis, the boring tool being provided with a deployable mixer device that presents a retracted position and a deployed position, the mixer device in the deployed positioned presenting a diametral span that is greater than its diametral span in a retracted position; and a device for injecting at least one fluid into the ground;

the method comprising:

performing an introduction step for introducing the boring tool into the ground along a boring axis parallel to the longitudinal axis so as to form a top portion having a first diameter, a first height, and extending to a first depth, the mixer device being in the retracted position during the introduction step; then performing a mixing step during which the mixer device is taken to the deployed position and the boring tool is driven in rotation with the mixer device in the deployed position while moving the boring tool axially along the boring axis and while injecting the fluid so as to perform mechanical in-situ mixing of the ground in place with the fluid, thereby forming a bulb in the ground under the top portion, which bulb has a second diameter that is greater than the first diameter;

making a borehole in the bulb along the boring axis and having a third diameter less than the second diameter;

filling the borehole with a bonding grout; and performing an insertion step during which the reinforcement is inserted in the bulb, the reinforcement being inserted into the borehole before or after filling the borehole with the bonding grout, whereby a ground anchor is obtained.

2. The method according to claim 1, wherein said reinforcement is constituted by a boring device used for making the borehole in the bulb.

3. The method according to claim 1, wherein the boring machine further comprises a tubular element having a diameter and a bottom end, the mixer device being shaped to be received inside the tubular element when the mixer device is in the retracted position, the diametral span of the mixer device in the deployed position being greater than the diameter of the tubular element, the method comprising, during the step of introducing the boring tool into the ground:

introducing the tubular element into the ground to the first depth along the boring axis;

introducing the boring tool in the retracted position into the tubular element; then after the step of introducing the boring tool into the ground, moving the boring tool axially along the boring axis relative to the tubular element so as to move the mixer device under the bottom end of the tubular element and then performing said mixing step.

4. The method according to claim 3, wherein, after the mixing step, the mixer device in the retracted position is put into the tubular element, and then during the introduction step:

securing the boring tool to the tubular element;

driving the assembly constituted by the boring tool and the tubular element in rotation and moving said assembly towards the bottom end of the bulb along the boring axis so as to make a borehole in the bulb;

separating the boring tool from the tubular element;

withdrawing the boring tool while leaving the tubular element in the bulb;

inserting the reinforcement into the tubular element; and filling the borehole with the bonding grout.

5. The method according to claim 3, wherein, during the introduction step;

initially introducing the tubular element into the ground, and then introducing the boring tool into the tubular element that has previously been introduced into the ground.

6. The method according to claim 3, wherein, during the introduction step:

simultaneously introducing the tubular element together with the boring tool into the ground, the mixer device being previously put in its retracted position and secured to the tubular element.

7. The method according to claim 3, comprising withdrawing the tubular element at the end of or during the insertion step.

8. The method according to claim 1, wherein the fluid is a binder.

9. The method according to claim 1, wherein the boring tool has a tubular body extending along the longitudinal axis, and wherein the mixer device has two deployable wings that are mounted to pivot relative to the tubular body.

10. The method according to claim 9, wherein the mixer device further comprises spring members arranged between the tubular body and each of the deployable wings, the spring members tending to bring the mixer device into the deployed position by pivoting the deployable wings.

11. The method according to claim 1, wherein the fluid is injected under pressure during the mixing step.

12. The method according to claim 1, wherein, at the end of the mixing step and before the insertion step:

replacing the initial material of the bulb constituted by the mixture of the ground in place with the fluid by a bonding material.

13. A method of constructing a prestressed anchoring tie-rod in ground beside a reaction mass, including performing the method according to claim 1, wherein the introduction step includes a preliminary step of making a borehole in the reaction mass comprising:

after obtaining the anchor, placing a tie-rod head between the reaction mass and the reinforcement, and then putting the reinforcement under tension.

14. A ground anchor, wherein, when considered from the surface of said ground, said anchor extends along a longitudinal axis and comprises in succession a top portion, followed by at least one bulb presenting a diameter greater than the diameter of the top portion, the top portion and the bulb comprising at least a first material, in that the anchor also comprises a reinforcement extending along the longitudinal axis in the top portion and in the bulb, and in that the reinforcement is covered in a second material over a covering diameter that is less than the diameter of the bulb.

15. The ground anchor according to claim 14, wherein the first material is constituted by a mixture of the excavated ground with a binder.

16. The ground anchor according to claim 14, wherein the second material forms a cylindrical covering extending longitudinally in the bulb and in the top portion.

17. The ground anchor according to claim 14, wherein the second material is a bonding grout.

18. The ground anchor according to claim 14, wherein the reinforcement comprises a metal bar, a tube, or at least one strand.

19. An anchoring tie-rod comprising a ground anchor according to claim 14.

* * * * *